US008748764B2

(12) United States Patent
Ahlert et al.

(10) Patent No.: US 8,748,764 B2
(45) Date of Patent: Jun. 10, 2014

(54) CASING OF A CIRCUIT BREAKER, IN PARTICULAR OF A CIRCUIT BREAKER FOR NOMINAL CURRENTS ABOVE 250A

(75) Inventors: Torsten Ahlert, Fürstenwalde (DE); Jan Grunwald, Berlin (DE); Katja Manthey, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 224 days.

(21) Appl. No.: 13/325,328

(22) Filed: Dec. 14, 2011

(65) Prior Publication Data

US 2012/0152704 A1 Jun. 21, 2012

(30) Foreign Application Priority Data

Dec. 15, 2010 (DE) ..... 10 2010 063 111

(51) Int. Cl.
*H01H 1/64* (2006.01)

(52) U.S. Cl.
USPC ..... 200/293

(58) Field of Classification Search
USPC ..... 200/293, 284, 238, 16 R–16 D
See application file for complete search history.

(56) References Cited

U.S. PATENT DOCUMENTS

| | | | | |
|---|---|---|---|---|
| 6,204,458 | B1 * | 3/2001 | Chen et al. | 200/284 |
| 2011/0000771 | A1 * | 1/2011 | Corti | 200/284 |

FOREIGN PATENT DOCUMENTS

| | | | |
|---|---|---|---|
| DE | 8211883 | U1 | 10/1982 |
| DE | 29513813 | U1 | 1/1997 |
| DE | 20111726 | U1 | 12/2002 |

OTHER PUBLICATIONS

German language Search Report for German Application No. DE 10 2010 063 111.6 dated Sep. 12, 2011.

German priority document for German Application No. DE 10 2010 063 111.6 (Not Yet Published).

* cited by examiner

*Primary Examiner* — Edwin A. Leon

(74) *Attorney, Agent, or Firm* — Harness, Dickey & Pierce, P.L.C.

(57) ABSTRACT

A casing of a circuit breaker for nominal currents above 250 A that enables at least one rigid busbar to be swung in to make contact with at least one switching pole attached in the casing. The casing may include a bottom section that cuboidally includes a rectangular base area and two rectangular side faces connected to the base area and running parallel to one another. Adjacent side faces are connected to one another via at least two stays which are arranged away from the opposing openings, delimited by the side faces, of the cuboidal bottom section, so that a switching pole can be inserted between the stays into the bottom section and so that a rigid busbar can be swung in at one of the two openings in order to make contact with the switching pole, when busbar and bottom section are each premounted, for example in a switching cabinet.

12 Claims, 4 Drawing Sheets

CASING OF A CIRCUIT BREAKER, IN PARTICULAR OF A CIRCUIT BREAKER FOR NOMINAL CURRENTS ABOVE 250A

PRIORITY STATEMENT

The present application hereby claims priority under 35 U.S.C. §119 on German patent application number DE 10 2010 063 111.6 filed Dec. 15, 2010, the entire contents of which are hereby incorporated herein by reference.

BACKGROUND

Circuit breakers are used to switch large currents, typically currents of more than 100 A. Typically a circuit breaker consists of a casing and switching poles fitted therein. The electrical opening and closing of the circuit is effected in the switching poles.

To simplify assembly of the switching poles use is made of a "casing". Typically this casing consists of a bottom section, a top section and a top cover. The switching poles are mounted in the bottom section, with the top section or top cover mounted above serving as cover and protection.

Above nominal currents of 250 A busbars are preferably used to carry the current rather than cable connections. These busbars are typically made of copper or aluminum. To mount a circuit breaker in an electrical installation the premounted, rigid busbars are first swung away, and then the circuit breaker is mounted in the bottom section of the casing and likewise premounted in the electrical installation. Finally the busbars are swung in and connected to the electrical contacts of the switching poles.

The premounted rigid busbars approximately describe a circular path when being swung away from or into the circuit breaker. The casing of the circuit breaker should be designed such that the busbars can be swung in to the contacts of the switching poles, if busbar and bottom section are for example premounted in a switching cabinet. After being swung in, the busbar is connected to the electrical contact of the switching pole, e.g. via a screw connection.

Until now the problem of being able to swing the rigid premounted busbars in has been solved by an array-like structure in the bottom section of the casing of the circuit breaker according to FIG. 4. For the chamber of an individual switching pole this means that in accordance with FIG. 4 the bottom section consists of a base area and two rectangular side faces running parallel to one another and connected to the base area. Typically casings are manufactured as cast housings made of a thermoplastic. The array-like structure in accordance with FIG. 4 proves to be of little advantage here because of the significant tendency of the bottom sections manufactured using a casting process to warp and collapse. This warping of the bottom section is shown in FIG. 5 on the basis of two bottom sections of a casing: the bottom section shown by dashed lines and the bottom section shown by unbroken lines show the strong geometric deviation of the injection-molded component from the desired shape.

SUMMARY

In at least one embodiment of the invention, an alternative solution is provided for a bottom section of a casing which enables rigid busbars to be swung into the casing when busbar and bottom section are premounted.

At least one embodiment is directed to a casing, wherein the bottom section cuboidally comprises a rectangular base area and two rectangular side faces running parallel to one another and connected to the base area, wherein adjacent side faces are connected to one another via at least two stays which are arranged at a distance from the two opposing openings of the cuboidal bottom section delimited by the side faces, so that a switching pole can be inserted between the stays in the bottom section and so that a rigid busbar can be swung in at one of the two openings to make contact with the switching pole, when busbar and bottom section are each premounted, for example in a switching cabinet.

The at least two stays of at least one embodiment of the inventive casing reduce the warping of the bottom section of the casing. In addition the at least two stays of the bottom section are able to absorb mechanical pressures in the interior of the casing which occur during switching, and as a result prevent a permanent deformation or destruction of the casing.

In one embodiment, the casing is a cast housing. In another embodiment, the casing is manufactured from a thermo-plastic, which can be a polyamide.

In another embodiment, the casing additionally contains a top section, which is fixed to the bottom section of the casing. Additionally the casing can have a top cover which is fixed to the top section of the casing.

In another embodiment, the stays of the bottom section are designed to be parallel to the rectangular base area. Likewise the stays of the bottom section can be planar. The stays can be arranged symmetrically apart in respect of the two opposing openings of the cuboidal bottom section.

BRIEF DESCRIPTION OF THE DRAWINGS

The invention is described below on the basis of the following figures.

FIG. 3 shows a typical circuit breaker with 3-part casing, wherein the rigid busbar can be swung in, FIG. 4 shows a bottom section of a typical circuit breaker casing, in which rigid busbars can be swung in, FIG. 7 shows a circuit breaker with inventive bottom section of a casing, three switching poles and a rigid busbar, wherein the busbar can be swung in.

DETAILED DESCRIPTION OF THE EXAMPLE EMBODIMENTS

Figure 1:
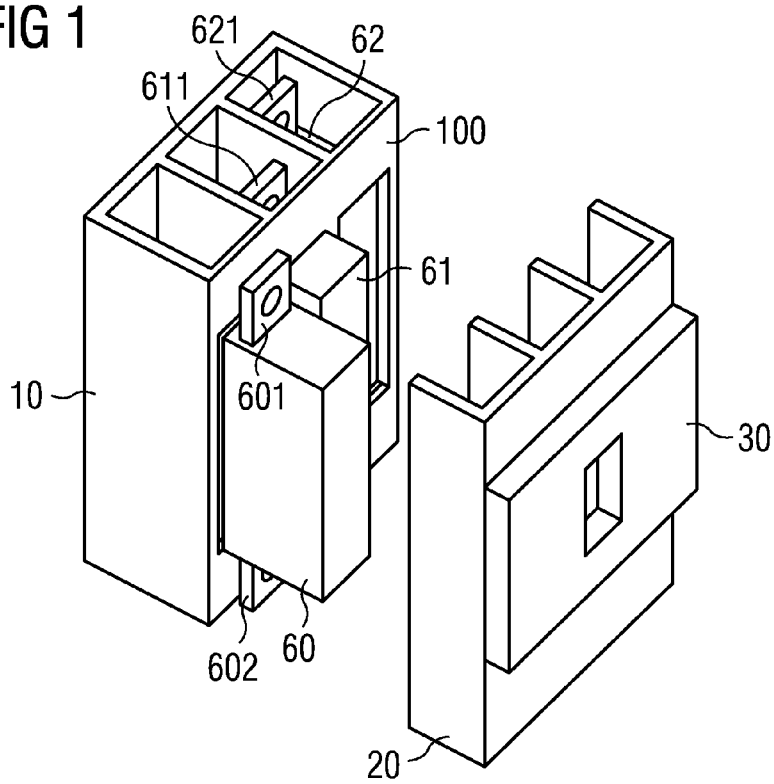
FIG. 1 shows a circuit breaker with 3-part casing and three switching poles.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows a typical circuit breaker. The circuit breaker includes a 3-part casing with bottom section 10, top section 20 and top cover 30. Three switching poles 60, 61, 62 can for example be mounted in the bottom section 10 of the casing 1 using screws and/or latch connections. FIG. 1 shows the three switching poles 60, 61, 62 in different mounting positions. Switching pole 62 is fully mounted, switching pole 61 is inserted into the bottom section 10 of the casing 1 but has not yet been mounted and switching pole 60 is ready to be swung into the bottom section 10 of the casing 1.

Typically the bottom section 10 of the casing 1 is designed to be cuboidal. According to the number of switching poles provided, the bottom section 10 has cuboidal chambers for accommodating them. A chamber is designed to be cuboidal with a pair of open end faces. The top 100 of a chamber of the bottom section 10 is provided with a rectangular opening, through which the switching pole 60, 61, 62 can be inserted. As the switching pole 60, 61, 62 cannot be pushed directly into the chamber of the bottom section 10 because of the contact surfaces 601, 602, 611, 621 attached to it, it has to be swung in.

To swing the switching pole 60, 61, 62 into the bottom section 10 of the casing 1 it must be tilted such that e.g. for switching pole 60 the first contact surface 601 is inserted through the opening of the top 100 of the bottom section 10. This is possible because the switching pole 60 is at an incline. After insertion of the first contact surface 601 of the switching pole 60 the second contact surface 602 can likewise be inserted through the opening of the bottom section 10 and the switching pole 60 can be conveyed, via an interim position, as shown in the case of the switching pole 61, to the mounting position as shown in the case of the switching pole 62.

Figure 2:
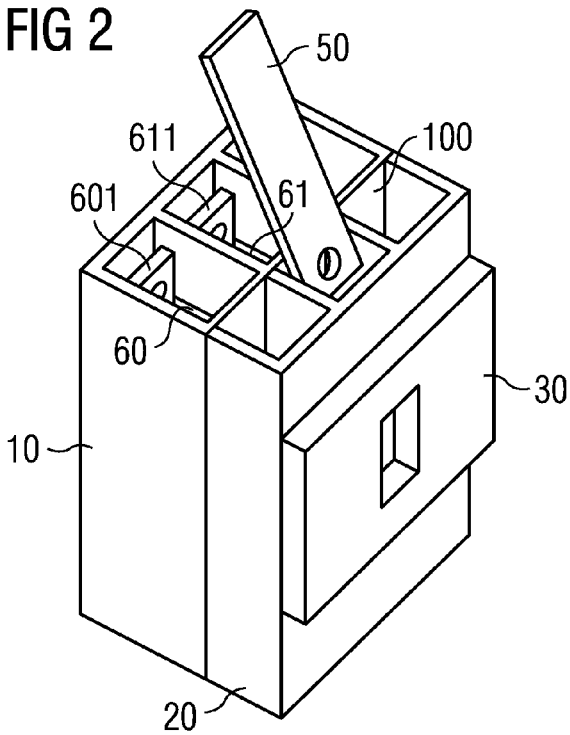
FIG. 2 shows a typical circuit breaker with casing and rigid busbar, wherein the busbar cannot be swung into the casing.

FIG. 2 shows a typical circuit breaker casing, as known from FIG. 1, after the switching poles 60, 61, 62 have been mounted and after the casing 1, which includes a bottom section 10, a top section 20 and a top cover 30, has been closed. The busbar 50 selected by way of example must now be brought into contact with the contact surface of the switching pole 61. The busbar 50 is permanently mounted at one end and describes a circular path when being swung in or out. Because of the top 100 of the bottom section 10 of the casing 1 the busbar 50 cannot be swung in and thus cannot be brought into contact with the contact surface 611 of the switching pole 61.

Figure 3:
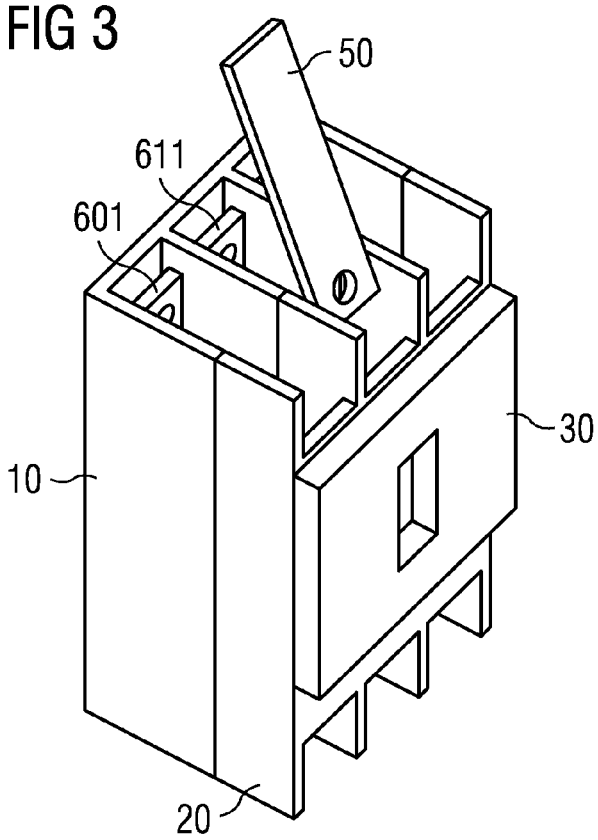
Figure 4:
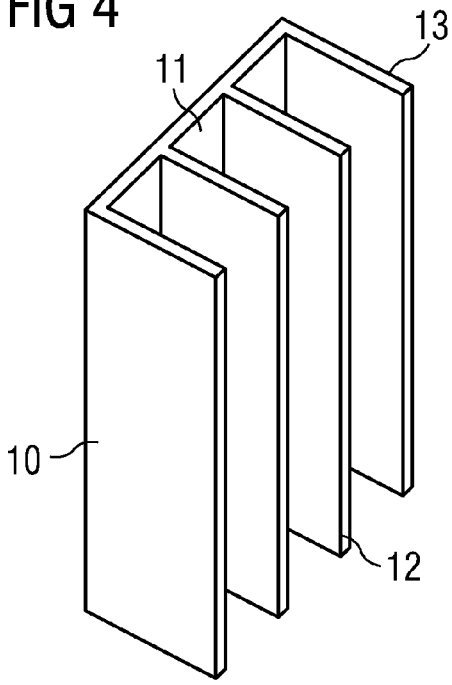

FIG. 3 shows a known solution for this problem. FIG. 3 shows a circuit breaker with a 3-part casing 1 including a bottom section 10, top section 20 and top cover 30. The bottom section 10 is shown in detail in FIG. 4. Bottom section 10 has an array-shaped structure with a base area 11 and parallel side walls 12, 13. The side walls 12, 13 form chambers which accommodate the switching poles 60, 61, 62. FIG. 4 shows three such chambers. Because of this design it is possible for busbar 50 to be swung in, after which the casing 1 can be connected to the contact 611 of the switching pole 61.

Figure 5:
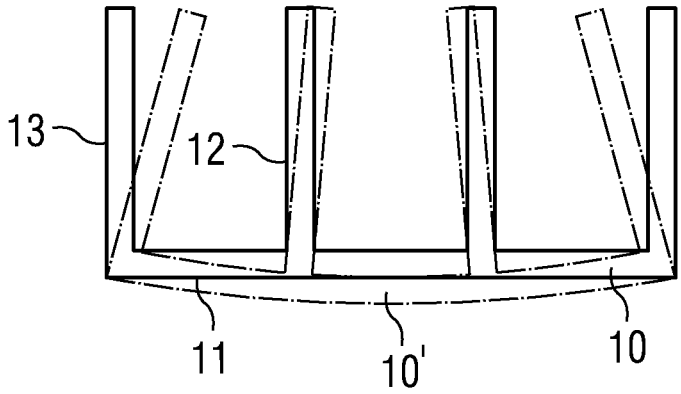
FIG. 5 shows a bottom section of a typical casing, side view.

Casings 1 for circuit breakers are typically manufactured from a thermoplastic. Typically these components are manufactured in a casting procedure. Because of the manufacturing tolerances a warping of the thermoplastic occurs. This warping is shown in FIG. 5, which shows a bottom section 10 of a casing 1 according to FIGS. 3 and 4, as it should optimally look after the thermoplastic casting process. This bottom section 10 is shown by continuous lines. Because of the significant warping the shape of the bottom section 10 typically changes according to the shape shown by the dashed lines 10'. In the event of significant warping, switching poles 60, 61, 62 can no longer be mounted in the bottom section 10', and likewise problems occur when mounting the top section 20, which can no longer be placed in form-fit manner onto the warped bottom section 10'.

Figure 6:
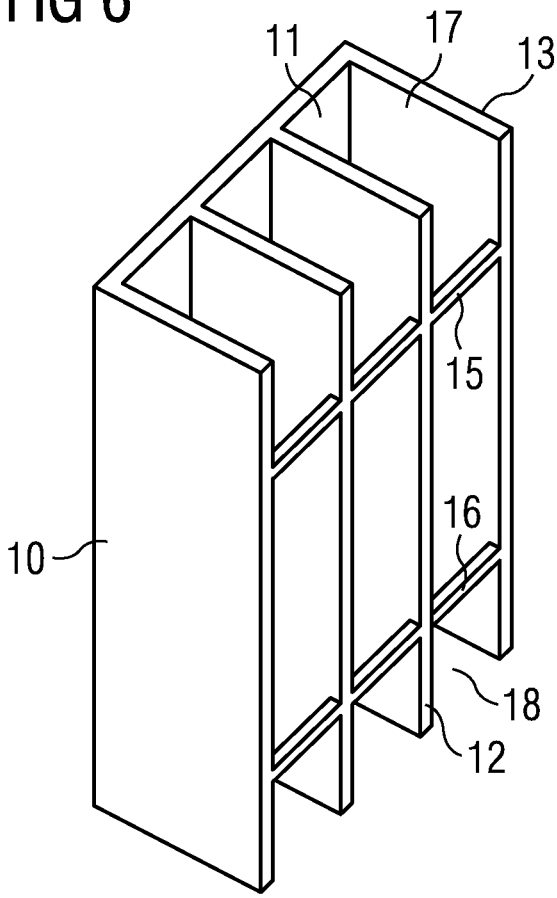
FIG. 6 shows an inventive bottom section of an embodiment of a casing for a circuit breaker with stays.

FIG. 6 shows an embodiment of an inventive solution for the bottom section 10 of a casing 1 of a circuit breaker. The array-shaped structure of the bottom section 10 with base area 11 and side faces 12, 13 is stabilized by stays 15, 16. For the individual chambers of a switching pole 60, 61, 62 this means that the bottom section 10 is cuboidal and includes a rectangular base area 11 and two rectangular side faces 12, 13 running parallel to one another and connected to the base area 11, wherein the side faces 12, 13 are connected to one another via at least two stays 15, 16, which are arranged away from the two opposing openings 17, 18 of the cuboidal bottom section 10. This arrangement allows the switching pole 60, 61, 62 to be inserted through the stays 15, 16 into the bottom section 10 and the rigid busbar 50 to be swung in at an opening of the premounted cuboidal bottom section 10 in order to make contact with the switching pole 60.

In one embodiment, the inventive bottom section 10 of the casing 1 of a circuit breaker is designed as a cast housing, it being possible for the casing 1 to be manufactured from a thermoplastic. The inventive casing 1 can be manufactured from polyamide.

The stays 15, 16 of the bottom section 10 can, as shown in FIG. 6, run parallel to the rectangular base area 11. Equally the stays 15, 16 of the bottom section 10 can be designed to be planar. It should be noted here in each case that the rigid busbar 50 can be swung in at an opening of the premounted cuboidal bottom section 10 in order to make contact with the switching pole 60, 61, 62 and that the switching pole 60, 61, 62 can be inserted through the stays 15, 16 into the bottom section 10. The stays 15, 16 of the bottom section 10 can be arranged symmetrically in respect of the two opposing openings 17, 18 of the cuboidal bottom section 10.

The stays 15, 16 must on the one hand be spaced far enough away from one another so that the switching pole 60, 61, 62 can be inserted into the bottom section 10 of the casing 1. On the other hand the stays 15, 16 must be far enough away from the opening of the cuboidal bottom section 10 that the rigid busbar 50 can be swung in in order to make contact with the switching pole 60, 61 62.

Figure 7:
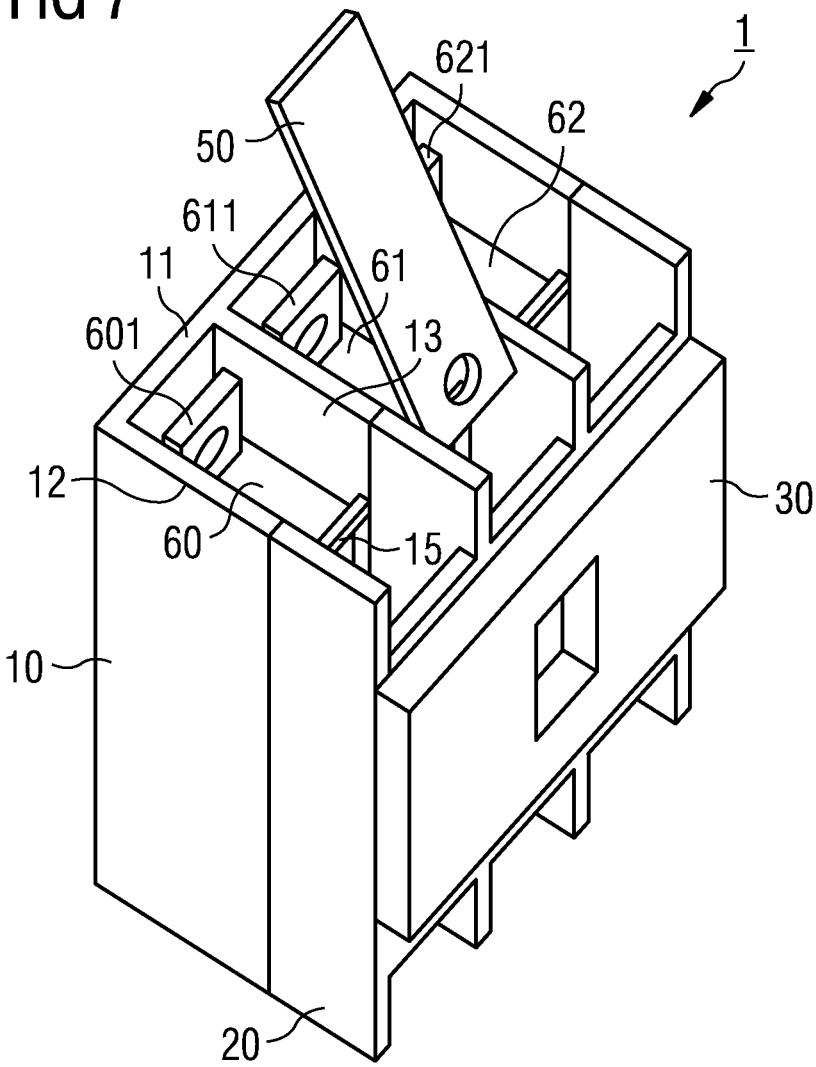

The complete inventive circuit breaker is shown in FIG. 7. It comprises a casing 1 consisting of a bottom section 10, a top section 20 and a top cover 30. Bottom section 10 inventively comprises stays 15, 16 which are arranged away from the two opposing openings of the cuboidal bottom section 10, so that the switching pole 60, 61, 62 can be inserted through the stays 15, 16 into the bottom section 10 and so that the rigid busbar 50 can be swung in at an opening of the cuboidal bottom section 10 in order to make contact with the switching pole 60, 61, 62 when busbar 50 and bottom section 10 are premounted.

Because of the stays 15, 16 the warping of the bottom section 10 of the casing 1 of the circuit breaker is dramatically reduced. Additionally the stays 15, 16 are able to absorb the pressures occurring in the interior of the casing 1 in the case of breaking capacities and thus prevent any permanent deformation or even destruction of the casing 1.

Thanks to a structural configuration of the bottom section 10 of the casing 1 of the circuit breaker the side faces 12, 13 of the bottom section 10 are additionally connected or braced. Thanks to this structural configuration it is possible to mount the switching pole 60, 61, 62 from the front and to swing the busbar 50 in.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A casing of a circuit breaker, which enables at least one rigid busbar to be swung in order to make contact with at least one switching pole attached in the casing, the casing comprising:

a cuboidal bottom section including, a base area, and two side faces connected to the base area, the two side faces running parallel to one another, wherein the two side faces are adjacent side faces connected to one another via at least two stays, the two stays being arranged away from two opposing openings of the cuboidal bottom section, the two opposing openings being delimited by the side faces, the two stays being arranged so that a switching pole is insertable between the stays into the cuboidal bottom section and so that a rigid busbar is swingable inward at one of the two opposing openings in order to make contact with the switching pole.

2. The casing as claimed in claim 1, wherein the casing is a cast housing.

3. The casing as claimed in claim 2, wherein the casing is manufactured from a thermoplastic.

4. The casing as claimed in claim 3, wherein the casing is manufactured from polyamide.

5. The casing as claimed in claim 1, further comprising:

a top section which, when the switching pole is mounted, is fixable to the cuboidal bottom section of the casing.

6. The casing as claimed in claim 5, further comprising:

a top cover, fixable to the top section of the casing.

7. The casing as claimed in claim 1, wherein the stays of the cuboidal bottom section run parallel to the base area.

8. The casing as claimed in claim 1, wherein the stays of the cuboidal bottom section are planar.

9. The casing as claimed in claim 1, wherein the stays of the cuboidal bottom section are arranged symmetrically away from the two opposing openings of the cuboidal bottom section.

10. The casing as claimed in claim 1, wherein the casing is of a circuit breaker for nominal currents above 250 A.

11. The casing as claimed in claim 1, wherein the busbar and cuboidal bottom section are each premounted in a switching cabinet.

12. The casing as claimed in claim 1, wherein the base area is rectangular and the two side faces are rectangular.

* * * * *